US011131953B1

(12) United States Patent
Miwa

(10) Patent No.: US 11,131,953 B1
(45) Date of Patent: Sep. 28, 2021

(54) PAPER FEEDING DEVICE AND IMAGE FORMING APPARATUS WITH REDUCED POWER CONSUMPTION

(71) Applicant: TOSHIBA TEC KABUSHIKI KAISHA, Tokyo (JP)

(72) Inventor: Shinji Miwa, Tokyo (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/123,389

(22) Filed: Dec. 16, 2020

(30) Foreign Application Priority Data

Jun. 16, 2020 (JP) ..... JP2020-103797

(51) Int. Cl.
*G03G 15/00* (2006.01)

(52) U.S. Cl.
CPC ..... *G03G 15/6502* (2013.01); *G03G 15/6594* (2013.01); *B65H 2407/31* (2013.01); *B65H 2407/311* (2013.01); *B65H 2515/83* (2013.01); *G03G 2215/00666* (2013.01); *G03G 2215/00738* (2013.01); *G03G 2215/00776* (2013.01)

(58) Field of Classification Search
CPC ..... G03G 15/5016; G03G 15/5029; G03G 15/6502; G03G 15/6508; G03G 15/6594; G03G 21/20; G03G 21/203; G03G 2215/00666; G03G 2215/00742; G03G 2215/00738; G03G 2215/00776; G03G 2215/00383; G03G 2215/00481; B65H 2407/31; B65H 2407/311; B65H 2301/142; B65H 2301/5143; B65H 2515/112; B65H 2515/83; B65H 2553/27; B65H 2801/06
USPC ..... 399/23, 44, 97, 389, 390, 393; 271/8.1
See application file for complete search history.

(56) References Cited

U.S. PATENT DOCUMENTS

2005/0067757 A1* 3/2005 Suga ..... B65H 3/48 271/98
2007/0000147 A1* 1/2007 Oyumi ..... B65H 1/00 34/535
2007/0228029 A1* 10/2007 Komatsu ..... B65H 3/48 219/216
2007/0235924 A1* 10/2007 Kimura ..... B65H 1/00 271/265.01
2008/0003000 A1* 1/2008 Taki ..... G03G 15/6502 399/44

(Continued)

FOREIGN PATENT DOCUMENTS

JP 08225169 A * 9/1996
JP 10228143 A * 8/1998

(Continued)

*Primary Examiner* — Robert B Beatty
(74) *Attorney, Agent, or Firm* — Amin, Turocy & Watson, LLP

(57) ABSTRACT

According to one embodiment, a paper feeding device includes a containing unit, a conveyance unit, a heater, a wiring, a thermostat, and a switch. The containing unit contains a sheet bundle. The conveyance unit conveys sheets from the sheet bundle contained in the containing unit one sheet by one. The heater heats the sheet bundle contained in the containing unit. The wiring supplies electric power to the heater. The thermostat controls a driving state of the heater. The switch is inserted in a middle of wiring and switches an ON state and an OFF state of the wiring in response to an input control signal.

20 Claims, 4 Drawing Sheets

(56) References Cited

U.S. PATENT DOCUMENTS

| | | | | |
|---|---|---|---|---|
| 2009/0302522 | A1* | 12/2009 | Fujimori | B65H 3/06 271/9.08 |
| 2010/0158593 | A1* | 6/2010 | Clark | G03G 21/203 399/390 |
| 2018/0217534 | A1* | 8/2018 | Ishii | G03G 15/2039 |

FOREIGN PATENT DOCUMENTS

| | | | | |
|---|---|---|---|---|
| JP | 2000264496 | A | * | 9/2000 |
| JP | 2004271915 | A | * | 9/2004 |
| JP | 2011-232616 | | | 11/2011 |
| JP | 2014006332 | A | * | 1/2014 |
| JP | 2015-001677 | | | 1/2015 |
| JP | 2015-046511 | | | 3/2015 |
| JP | 2019167198 | A | * | 10/2019 |

* cited by examiner

PAPER FEEDING DEVICE AND IMAGE FORMING APPARATUS WITH REDUCED POWER CONSUMPTION

CROSS-REFERENCE TO RELATED APPLICATION

This application is based upon and claims the benefit of priority from Japanese Patent Application No. 2020-103797, filed on Jun. 16, 2020, the entire contents of which are incorporated herein by reference.

FIELD

Embodiments described herein relate generally to a paper feeding device and an image forming apparatus.

BACKGROUND

Conventionally, there is an image forming apparatus that suppresses moisture absorption of a sheet by a dehumidifying device to suppress poor conveyance such as paper jams and paper wrinkles. However, in the above image forming apparatus, since the dehumidifying device is always driven regardless of the sheet type, there is a problem that the dehumidifying device continues to operate even for a sheet in which moisture absorption is difficult to occur, so that electric power is unnecessarily consumed.

DETAILED DESCRIPTION

Figure 1:
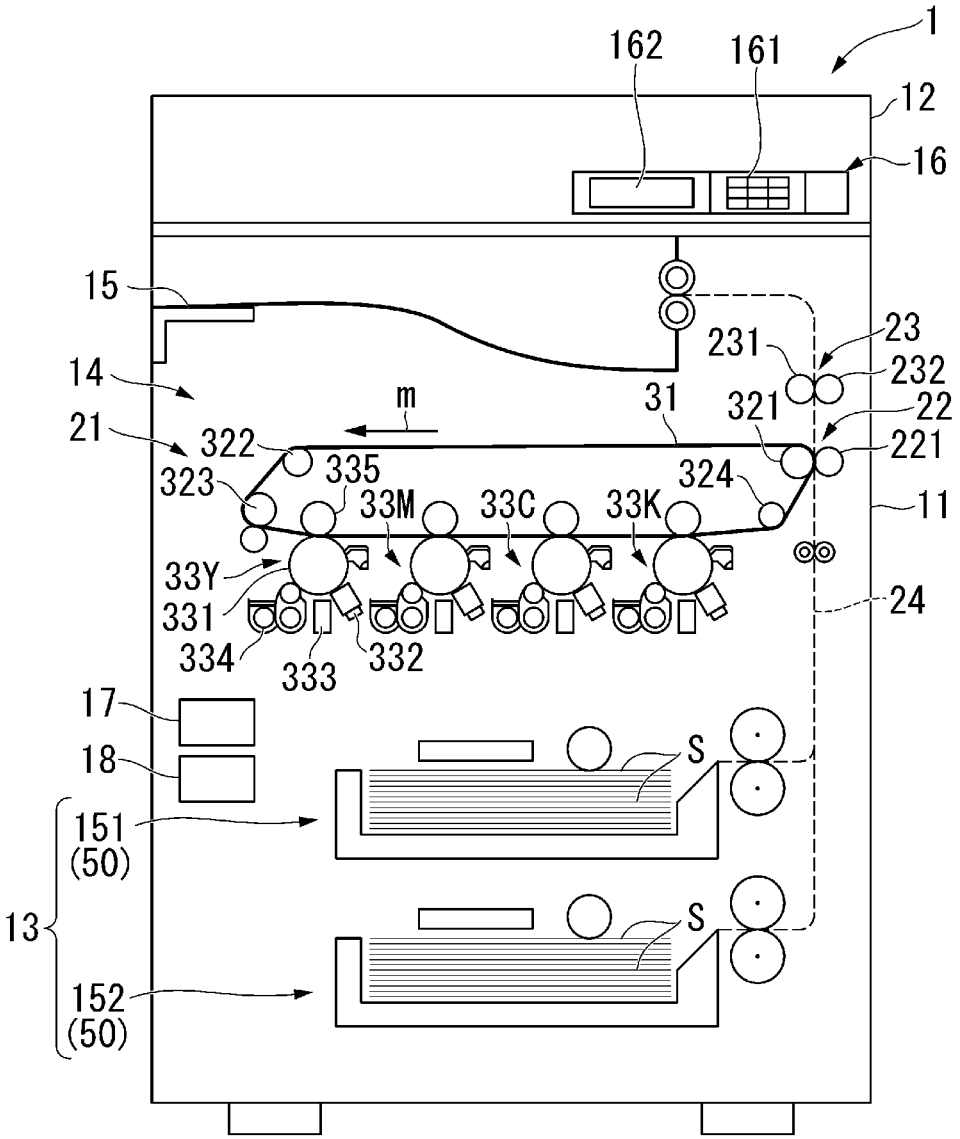
FIG. 1 is a front view illustrating an overall configuration of an image forming apparatus of an embodiment.

A concern addressed herein is to provide a paper feeding device and an image forming apparatus capable of suppressing poor conveyance and paper wrinkles due to moisture absorption while unnecessary power consumption is suppressed.

In general, according to one embodiment, a paper feeding device includes a containing unit, a conveyance unit, a heater, a wiring, a thermostat, and a switch. The containing unit contains a sheet bundle. The conveyance unit conveys sheets from the sheet bundle contained in the containing unit one sheet by one. The heater heats the sheet bundle contained in the containing unit. The wiring supplies electric power to the heater. The thermostat controls a driving state of the heater. The switch is inserted in a middle of wiring and switches an ON state and an OFF state of the wiring in response to an input control signal.

Hereinafter, a paper feeding device and an image forming device of an embodiment are described with reference to the drawings. In the following figures, unless otherwise specified, the same or equivalent configurations are denoted by the same reference numerals.

FIG. 1 is a front view illustrating an overall configuration of the image forming apparatus of the embodiment. For example, an image forming apparatus 1 is a multi-function peripheral (MFP). However, the image forming apparatus 1 is not limited to the above example and may be a copying machine, a printer, or the like.

As illustrated in FIG. 1, the image forming apparatus 1 includes a housing 11, a scanner unit 12, a paper feeding device 13, a printer unit 14, a paper ejection unit 15, a control panel 16, a control unit 17, and a power supply unit 18.

The housing 11 forms an outer enclosure of the image forming apparatus 1. The housing 11 contains the scanner unit 12, the paper feeding device 13, the printer unit 14, the control unit 17, and the power supply unit 18. The image forming apparatus 1 is driven by each part operating with electric power supplied from the power supply unit 18.

The scanner unit 12 reads image of a target to be read based on brightness and darkness of light. The scanner unit 12 generates and records image information indicating the read image. The scanner unit 12 outputs generated image information to the printer unit 14. The recorded image information may be transmitted to external devices or the like via a network.

The paper feeding device 13 supplies sheets S which are sheet-like recording media such as paper to a conveyance path 24 one sheet by one at the timing when the printer unit 14 forms a toner image.

The printer unit 14 forms a toner image which is an output image with a recording agent such as a toner to the sheets S based on the image information obtained from the scanner unit 12 or the external device.

According to the embodiment, for easier description, an example of the printer unit 14 of an intermediate transfer method is described. The configuration of the embodiment can be applied also to an image forming apparatus having a printer unit of a direct transfer method. The printer unit 14 includes an intermediate transfer unit 21, a secondary transfer unit 22, a fixing device 23, and the conveyance path 24.

The intermediate transfer unit 21 includes an intermediate transfer belt 31, a plurality of rollers 321, 322, 323, and 324, and a plurality of image forming units 33Y, 33M, 33C, and 33K.

The intermediate transfer belt 31 is formed in an endless shape. The plurality of rollers 321, 322, 323, and 324 support the intermediate transfer belt 31. As a result, the intermediate transfer belt 31 can travel endlessly in the direction indicated by an arrow m in FIG. 1.

The plurality of image forming units 33Y, 33M, 33C, and 33K include the yellow image forming unit 33Y, the magenta image forming unit 33M, the cyan image forming unit 33C, and the black image forming unit 33K. Each of the image forming units 33Y, 33M, 33C, and 33K includes a photoconductor drum 331, a charging charger 332, an exposure unit 333, a developing device 334, and a transfer roller 335. Each of the image forming units 33Y, 33M, 33C, and 33K transfers a toner image formed on the surface of the photoconductor drum 331 to the intermediate transfer belt 31.

The secondary transfer unit 22 includes a transfer roller 221. The transfer roller 221 is in contact with the outer surface of the intermediate transfer belt 31. The belt roller 321 which is one of the rollers which support the intermediate transfer belt 31 is included in the components of the secondary transfer unit 22. The sheets S is interposed between the transfer roller 221 and the belt roller 321 together with the intermediate transfer belt 31. Therefore, the toner image on the intermediate transfer belt 31 is transferred to the sheets S.

The fixing device 23 includes a heat roller 231 and a press roller 232. The fixing device 23 heats and pressurizes the sheets S passing a portion between the heat roller 231 and the press roller 232. Accordingly, the toner image transferred to the sheets S is fixed to the sheets S.

The conveyance path 24 is formed from the paper feeding device 13 to the paper ejection unit 15 via the secondary transfer unit 22 and the fixing device 23. The sheets S is conveyed by the conveyance path 24 to move from the paper feeding device 13 to the paper ejection unit 15 via the secondary transfer unit 22 and the fixing device 23. The paper ejection unit 15 discharges the sheets S on which an image is formed by the printer unit 14.

The control panel 16 includes a panel 161 and a display 162. The panel 161 receives inputs of various operation instructions. The display 162 is an image display device such as a liquid crystal display (LCD) or an organic electro luminescence (EL) display. The display 162 displays various kinds of information relating to the image forming apparatus 1. For example, the display 162 displays an operation mode of the image forming apparatus 1 which is selected by a user. The operation mode includes a sheet type setting mode for setting a type of a sheet for forming an image. The control panel 16 of the present embodiment receives input operations with respect to the entire image forming apparatus 1, but a control panel dedicated to the paper feeding device 13 may be independently provided.

The image forming apparatus 1 designates an operation mode, for example, by the panel 161 performing an operation input of pressing an input button or the like. Otherwise, the user performs an operation input of tapping an icon, or the like display on a touch panel integrally configured with the display 162 and the panel 161 to designate an operation mode of the image forming apparatus 1.

The control unit 17 controls the entire image forming apparatus 1. For example, the control unit 17 controls operations of the scanner unit 12, the paper feeding device 13, the printer unit 14, and the control panel 16.

Subsequently, a hardware configuration of the image forming apparatus 1 is described with reference to FIG. 2.

Figure 2:
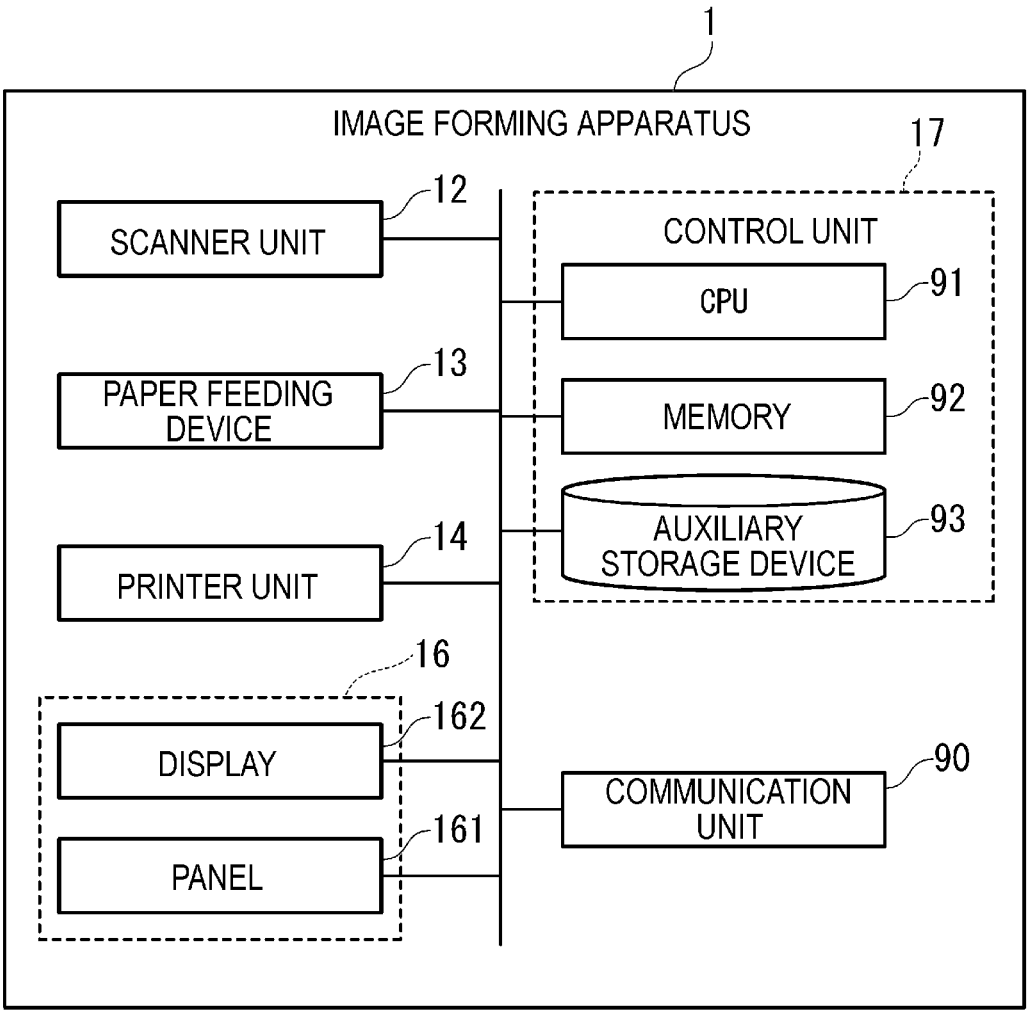
FIG. 2 is a hardware configuration diagram.

FIG. 2 is a hardware configuration diagram of the image forming apparatus 1 of the embodiment.

The image forming apparatus 1 includes the scanner unit 12, the paper feeding device 13, the printer unit 14, the control panel 16 including the panel 161 and the display 162, the control unit 17, and a communication unit 90. Each functional part is connected to each other via a bus.

The control unit 17 includes a central processing unit (CPU) 91, a memory 92, and an auxiliary storage device 93. Other processors may be used instead of the CPU 91. For example, the CPU 91 reads a program stored in the auxiliary storage device 93 and loads the program into the memory 92. The CPU 91 controls an operation of the image forming apparatus 1 by performing a program loaded into the memory 92.

The memory 92 and the auxiliary storage device 93 are configured to include various storage media. The memory 92 and the auxiliary storage device 93 may be configured with an integrated storage medium.

The memory 92 temporarily stores data and a program used by each functional unit included in the image forming apparatus 1. For example, the memory 92 is configured to include a storage medium such as a random access memory (RAM).

The auxiliary storage device 93 stores data and a program used by each functional unit included in the image forming apparatus 1. For example, the auxiliary storage device 93 is configured to include a hard disk drive (HDD), a solid state drive (SSD), a read only memory (ROM), or a set of these storage media.

The communication unit 90 is a communication interface for communication connection of the image forming apparatus 1 with an external device.

Subsequently, the configuration of the paper feeding device 13 is specifically described.

Figure 3:
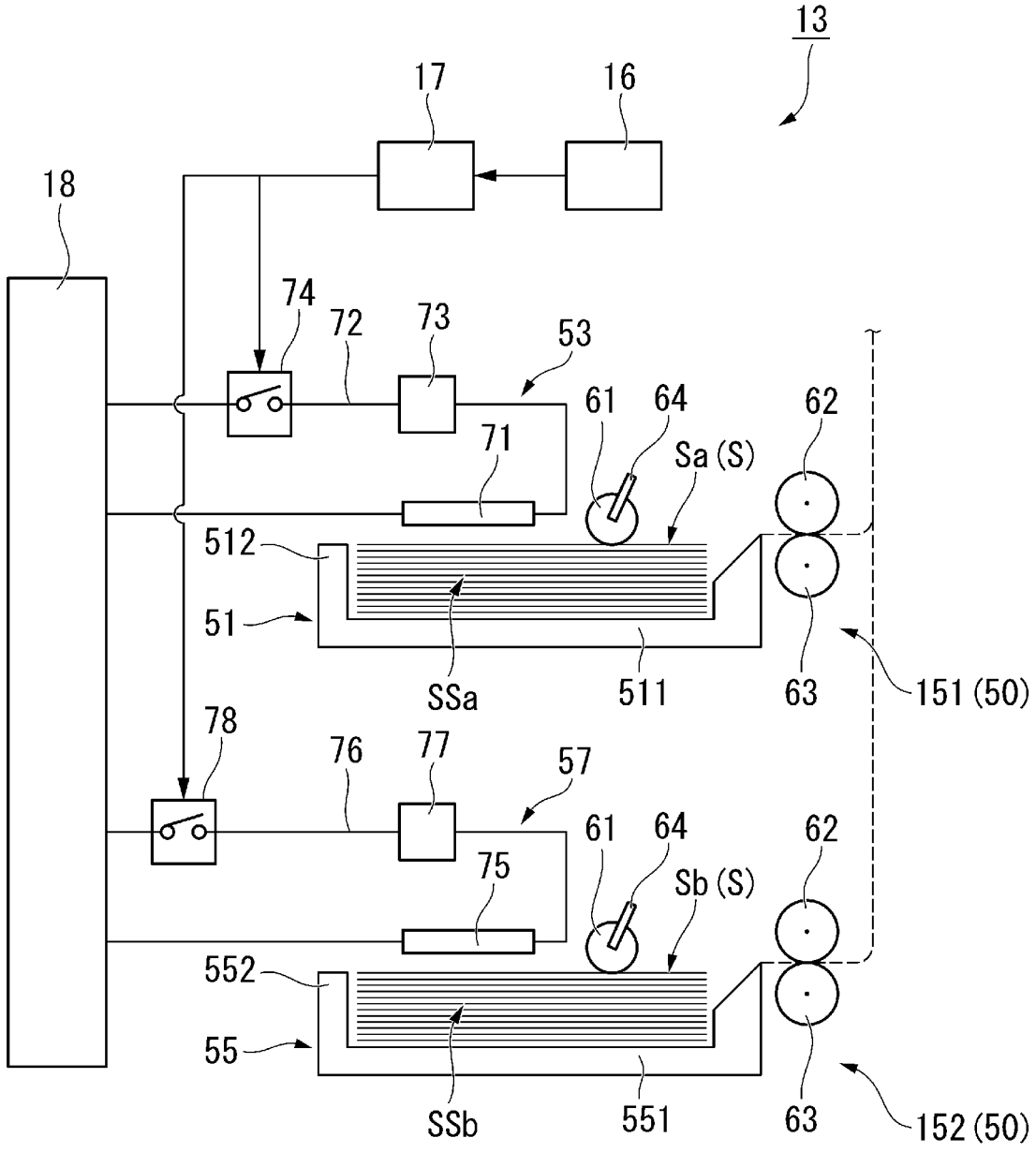
FIG. 3 is a schematic diagram illustrating a configuration of a paper feeding device.

FIG. 3 is a schematic diagram illustrating a configuration of the paper feeding device 13.

As illustrated in FIG. 3, the paper feeding device 13 of the embodiment includes a plurality of paper feed units 50. According to the embodiment, the plurality of paper feed units 50 includes a first paper feed unit 151 and a second paper feed unit 152. The number of the paper feed units 50 in the paper feeding device 13 is not limited to 2, may be 1, and may be 3 or more.

The first paper feed unit 151 includes a first containing unit 51, a first conveyance unit 52, and a first heater unit 53.

The first containing unit 51 of the embodiment is a paper feed cassette. The first containing unit 51 is detachably attached to the housing 11 as illustrated in FIG. 1. The first containing unit 51 includes a bottom wall 511 and a side wall 512 which stands from the peripheral end of the bottom wall 511. The first containing unit 51 is formed in a concave shape with an upper portion opened. The first containing unit 51 is a containing unit that contains the sheets S for printing an image. According to the present embodiment, the sheets S that are contained in the first containing unit 51 are called first sheets Sa. The first containing unit 51 according to the embodiment contains a first sheet bundle SSa as a sheet bundle including the plurality of first sheets Sa.

The first conveyance unit 52 is a conveyance unit that conveys the first sheets Sa from the first sheet bundle SSa contained in the first containing unit 51 one sheet by one. The first conveyance unit 52 includes a pick-up roller 61, a paper feed roller 62, and a separation roller 63.

The pick-up roller 61 is provided on the first containing unit 51. The pick-up roller 61 sends the first sheet Sa on the uppermost portion of the first sheet bundle SSa contained in the first containing unit 51 to the paper feed roller 62. If the first containing unit 51 is detached from the housing 11 illustrated in FIG. 1, the pick-up roller 61 is retracted upward by a pick-up roller drive unit 64. If the first containing unit 51 is closed with respect to the housing 11, the pick-up roller 61 moves to a position which is in contact with the upper surface of the first sheet bundle SSa by the pick-up roller drive unit 64.

The paper feed roller 62 and the separation roller 63 are provided at the downstream of the sheet conveyance direction with respect to the first containing unit 51. For example, each of the paper feed roller 62 and the separation roller 63 is driven by a drive source such as a motor. The paper feed roller 62 sends the first sheet S supplied from the first containing unit 51 to the conveyance path 24. If two sheets of the first sheets Sa are conveyed from the first containing unit 51, the separation roller 63 returns the first sheet Sa on the lower portion among the two sheets of the first sheets Sa to the first containing unit 51.

The first heater unit 53 dehumidifies the first sheets Sa by heating the first sheet bundle SSa contained in the first containing unit 51. The first heater unit 53 includes a first heater 71, a first wiring 72, a first thermostat 73, and a first switch 74.

The first heater 71 is a heater that heats the first sheet bundle SSa. For example, the first heater 71 is configured with a panel-like heater using a heating wire, or a hot air heater. The first heater 71 is provided to face the upper surface of the first sheet bundle SSa. The first heater 71 is provided on the bottom wall 511 or the side wall 512 of the first containing unit 51.

The first wiring 72 is a wiring that is connected to the power supply unit 18 and that supplies electric power from the power supply unit 18 to the first heater 71.

The first thermostat 73 is inserted in the middle of the first wiring 72. If it reaches a preset temperature, a contact point of the first thermostat 73 is automatically opened and closed. The first thermostat 73 opens the contact point if the ambient temperature is higher than 20° C. If the contact point is opened in the first thermostat 73, the electric power from the power supply unit 18 is not supplied to the first heater 71. The first thermostat 73 closes the contact point if the ambient temperature is lower than 20° C. If the contact point is closed in the first thermostat 73, the electric power from the power supply unit 18 can be supplied to the first heater 71. The first thermostat 73 according to the embodiment is a thermostat that controls a driving state of the first heater 71 based on the ambient temperature.

The first switch 74 is inserted in the middle of the first wiring 72. The first switch 74 according to the embodiment is a relay. The first switch 74 is electrically connected to the control unit 17. The first switch 74 may be configured with a transistor. The control unit 17 outputs a control signal for switching the driving state of the first heater 71 to ON or OFF with respect to the first switch 74. The first switch 74 is a switch that switches the ON state or the OFF state of the first wiring 72 in response to the control signal input from the control unit 17.

The second paper feed unit 152 has the same configuration with the first paper feed unit 151. The second paper feed unit 152 includes a second containing unit 55, a second conveyance unit 56, and a second heater unit 57.

The second containing unit 55 is a paper feed cassette. The second containing unit 55 is detachably attached to the housing 11 illustrated in FIG. 1. The second containing unit 55 has the same configuration as the first containing unit 51. The second containing unit 55 has a bottom wall 551 and a side wall 552 which stands from the peripheral end of the bottom wall 551. The second containing unit 55 is formed in a concave shape with an upper portion opened. The second containing unit 55 contains second sheets Sb which are sheets different from the first sheets Sa as the sheets S for printing an image. The second containing unit 55 according to the embodiment contains a second sheet bundle SSb as a different sheet bundle including the plurality of second sheets Sb.

The second sheet Sb contained in the second containing unit 55 may have the same type or size as the first sheet Sa contained in the first containing unit 51 or may have a different type or size. In the image forming apparatus 1 according to the embodiment, the first sheet Sa and the second sheet Sb are different types of sheets. The first sheet Sa is a plain paper, and the second sheet Sb is thick paper. According to the embodiment, for example, the plain paper means paper having a basis weight of about 35 to 90 g/m$^2$, and the thick paper means paper having a basis weight of more than 90 g/m$^2$.

The second conveyance unit 56 conveys the second sheet Sb from the second sheet bundle SSb contained in the second containing unit 55 one sheet by one. The second conveyance unit 56 has the same configuration as the first conveyance unit 52. In the same manner as in the first conveyance unit 52, the second conveyance unit 56 includes the pick-up roller 61, the paper feed roller 62, and the separation roller 63.

The second heater unit 57 has the same configuration as the first heater unit 53. The second heater unit 57 includes a second heater 75, a second wiring 76, a second thermostat 77, and a second switch 78. The second heater 75 heats the second sheet bundle SSb. The second heater 75 is a heater different from the first heater 71. The second heater 75 is provided to face the upper surface of the second sheet bundle SSb. The second heater 75 may be provided on the bottom wall 551 or the side wall 552 of the second containing unit 55. The second wiring 76 is a wiring different from the first wiring 72 that is connected to the power supply unit 18 and supplies electric power to the second heater 75.

The second thermostat 77 is inserted in the middle of the second wiring 76. In the same manner as the first thermostat 73, the second thermostat 77 opens the contact point if the ambient temperature is higher than 20° C. and closes the contact point if the ambient temperature is lower than 20° C. The second thermostat 77 is a thermostat different from the first thermostat 73 that controls a driving state of the second heater 75 based on the ambient temperature.

The second switch 78 is inserted in the middle of the second wiring 76. The second switch 78 according to the embodiment is a relay. The second switch 78 is electrically connected to the control unit 17. The second switch 78 may be configured with a transistor. The control unit 17 outputs the control signal for switching the driving state of the second heater 75 to ON or OFF with respect to the second switch 78. The second switch 78 is a different switch that can switch the ON state and the OFF state of the second wiring 76 in response to the control signal input from the control unit 17 independently from the first switch 74.

Hereinafter, an example of an operation of the image forming apparatus 1 according to the embodiment is described.

Figure 4:
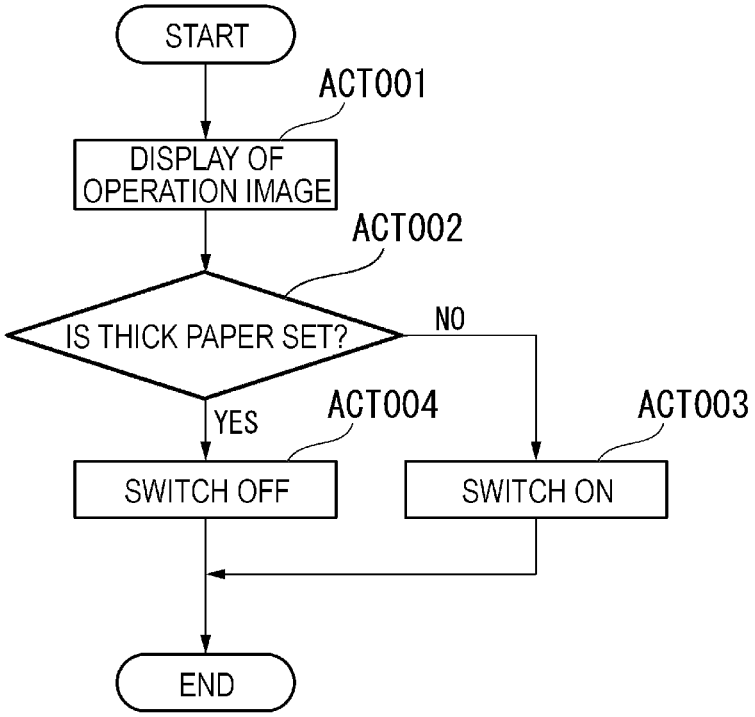
FIG. 4 is a flowchart illustrating an example of the operation of the image forming apparatus.

FIG. 4 is a flowchart illustrating an example of the operation of the image forming apparatus 1 of the embodiment. This flowchart starts if an instruction for setting a sheet type is output to the control unit 17 of the image forming apparatus 1.

The instruction for setting a sheet type is output to the control unit 17 in any one of a case where the first sheet bundle SSa is set in the first containing unit 51 or a case where the second sheet bundle SSb is set in the second containing unit 55.

Figure 5:
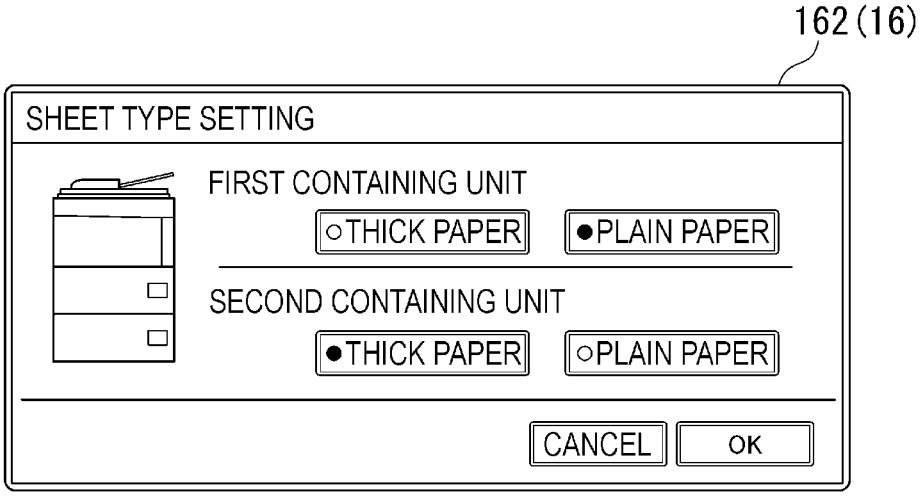
FIG. 5 is a diagram illustrating an operation image for setting a paper type to be displayed on a panel unit.

If receiving the instruction for setting a sheet type, the control unit 17 displays an operation image for setting the sheet type to the panel 161 of the control panel 16 (ACT 001). FIG. 5 is a diagram illustrating an operation image for setting a sheet type to be displayed on the panel 161.

In an operation menu illustrated in FIG. 5, an input operation for setting the first sheet Sa contained in the first containing unit 51 as a plain paper and setting the second sheet Sb contained in the second containing unit 55 as a thick paper is performed.

If an input operation for setting a sheet type is performed on the control panel 16 performs, the control unit 17 outputs the control signal to the first switch 74 of the first heater unit 53 and the second switch 78 of the second heater unit 57 in response to the input result.

With respect to the instruction for setting a sheet type, if the thick paper is not set (No in ACT 002), the control unit 17 outputs the control signal setting the first switch 74 to be in the ON state to the first switch 74 of the first heater unit 53 corresponding to the first sheet Sa which is the plain paper (ACT 003).

If the first switch 74 is in the ON state, the first heater unit 53 is in the state in which the electric power from the power supply unit 18 is supplied to the first heater 71. The first heater unit 53 is in the state in which the driving state of the first heater 71 can be controlled by the first thermostat 73. If the ambient temperature is lower than 20° C., the first thermostat 73 drives the first heater 71 so that the first heater unit 53 can be dehumidified by heating the first sheet Sa which is the plain paper.

Meanwhile, in the instruction for setting the sheet type, if the thick paper is set (Yes in ACT 002), the control unit 17 outputs the control signal setting the second switch 78 to be in the OFF state to the second switch 78 of the second heater unit 57 corresponding to the second sheet Sb which is the thick paper (ACT 004).

If the second switch 78 is in the OFF state, the second heater unit 57 is in a state in which a circuit that supplies electric power to the second heater 75 is blocked. The electric power from the power supply unit 18 is not supplied to the second heater 75 of the second heater unit 57. The second heater unit 57 does not forcibly drive the second heater 75 regardless of the control of the second thermostat 77.

In the above, the operation of setting a sheet type in the image forming apparatus 1 illustrated in the flowchart of FIG. 4 ends.

In the past, it is likely that poor conveyance and paper wrinkles may be caused in a plain paper due to moisture absorption. In the paper feeding device 13 of the embodiment, if the plain paper is used as the first sheets Sa, the first heater 71 can be effectively functioned by switching the first switch 74 that is inserted in the middle of the first wiring 72 supplying the electric power to the first heater 71 by the control signal from the control unit 17 to the ON state. Since the first sheet Sa is dehumidified by heating by the first heater 71, the moisture absorption can be suppressed. If the first sheet Sa which is the plain paper contained in the first containing unit 51 of the first paper feed unit 151 is conveyed, the paper feeding device 13 according to the embodiment can suppress poor conveyance and paper wrinkles due to the moisture absorption.

The second sheet Sb which is the thick paper is less likely influenced by moisture absorption compared with the first sheet Sa which is the plain paper, and if a dehumidification operation is performed on the second sheet Sb, the electric power for driving the second heater 75 is unnecessarily consumed.

In the paper feeding device 13 of the embodiment, if the thick paper is used as the second sheet Sb, the second switch 78 that is inserted in the middle of the second wiring 76 supplying electric power to the second heater 75 by the control signal from the control unit 17 is switched to the OFF state so that the second heater 75 is not forcibly functioned. The paper feeding device 13 according to the embodiment can save energy by eliminating unnecessarily electric power consumption by the second heater 75.

According to the image forming apparatus 1 of the embodiment, the unnecessarily electric power consumption is suppressed, and the poor conveyance or the paper wrinkles due to the moisture absorption can be suppressed, as described above.

The paper feeding device according to the embodiment can be applied to a paper feeding device performing a method of transferring a sheet to a portion between the first containing unit and the second containing unit disposed to be adjacent to each other. For example, if there is no sheet contained in the first containing unit, a sheet bundle contained in the second containing unit may be transferred to the first containing unit side.

If the method of transferring a sheet to a portion between the first containing unit and the second containing unit is employed, the method can be applied to a structure in which the first containing unit and the second containing unit are provided inside the housing of the image forming apparatus. The method also can be applied to a configuration in which the first containing unit is provided inside the housing of the image forming apparatus, and the second containing unit is attached to the outside of the housing.

The image forming apparatus 1 of the embodiment can be applied to a method in which the control unit 17 outputs the control signal to the first switch 74 and the second switch 78 based on a detection signal from a detecting unit that can discriminate the sheet type instead of the input operation from the control panel 16.

As the paper feeding device 13 of the embodiment, a configuration of switching the first switch 74 and the second switch 78 based on the control signal output from the control unit 17 of the image forming apparatus 1 is exemplified, but the paper feeding device 13 of the embodiment can be applied to a configuration provided with a control unit dedicated to the paper feeding device. In this case, the control unit dedicated to the paper feeding device in the paper feeding device 13 controls the switching of the first switch 74 and the second switch 78 based on the control signal output from the control unit 17 of the image forming apparatus 1.

While certain embodiments have been described, these embodiments have been presented by way of example only, and are not intended to limit the scope of the inventions. Indeed, the novel embodiment described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A paper feeding device, comprising:

a containing component configured to contain a sheet bundle;

a conveyance component configured to convey sheets from the sheet bundle contained in the containing component one sheet by one;

a heater configured to heat the sheet bundle contained in the containing component;

a wiring configured to supply electric power to the heater;

a thermostat configured to control a driving state of the heater;

a first switch insertable in a middle of the wiring and switchable between an ON state and an OFF state of the wiring in response to an input control signal;

a second containing component configured to contain a second sheet bundle;

a second heater configured to heat the second sheet bundle contained in the second containing component;

a second wiring configured to supply electric power to the different heater;

a second thermostat configured to control the second heater; and a second switch configured to be inserted in a middle of the second wiring and be capable of switching an ON state and an OFF state of the second wiring independently from the first switch in response to the control signal.

2. The paper feeding device according to claim 1, wherein the sheet bundle comprises a plain paper having a basis weight of about 35 to 90 g/m$^2$, and the second sheet bundle comprises a thick paper having a basis weight of more than 90 g/m$^2$.

3. The paper feeding device according to claim 1, wherein the sheet bundle comprises sheets having a different surface area size than sheets in the second sheet bundle.

4. The paper feeding device according to claim 1, wherein the sheet bundle comprises sheets having a same surface area size than sheets in the second sheet bundle.

5. The paper feeding device according to claim 1, wherein the first switch is a relay, if the sheet bundle contained in the containing component is a plain paper, the first switch is in an ON state, and if the sheet bundle contained in the containing component is thick paper thicker than the plain paper, the first switch is in an OFF state.

6. The paper feeding device according to claim 5, wherein the plain paper has a basis weight of about 35 to 90 g/m$^2$, and the thick paper has a basis weight of more than 90 g/m$^2$.

7. The paper feeding device according to claim 5, wherein the plain paper has a same surface area size as the thick paper.

8. The paper feeding device according to claim 1, wherein the heater is one of a hot air heater or a panel-like heater.

9. The paper feeding device according to claim 1, wherein the thermostat controls the driving state of the heater based on whether an ambient temperature is above or below 20° C.

10. An image forming apparatus, comprising:

a paper feeding device, comprising:

a containing component configured to contain a sheet bundle;

a conveyance component configured to convey sheets from the sheet bundle contained in the containing component one sheet by one;

a heater configured to heat the sheet bundle contained in the containing component;

a wiring configured to supply electric power to the heater;

a thermostat configured to control a driving state of the heater; and a first switch insertable in a middle of the wiring and switchable between an ON state and an OFF state of the wiring in response to an input control signal;

a printer configured to form an image on the sheet conveyed by the conveyance component from the containing component;

a control panel configured to receive an input of information on whether the sheet is thick paper; and a controller configured to output the control signal based on the information input to the control panel;

wherein the controller outputs the control signal for causing the first switch to be in an ON state if the sheet is a plain paper and causing the first switch to be in an OFF state if the sheet is thick paper thicker than the plain paper.

11. The image forming apparatus according to claim 10, further comprising:

a second containing component configured to contain a second sheet bundle;

a second heater configured to heat the second sheet bundle contained in the second containing component;

a second wiring configured to supply electric power to the different heater;

a second thermostat configured to control the second heater; and a second switch configured to be inserted in a middle of the second wiring and be capable of switching an ON state and an OFF state of the second wiring independently from the first switch in response to the control signal.

12. The image forming apparatus according to claim 11, wherein the sheet bundle comprises a plain paper having a basis weight of about 35 to 90 g/m$^2$, and the second sheet bundle comprises a thick paper having a basis weight of more than 90 g/m$^2$.

13. The image forming apparatus according to claim 11, wherein the sheet bundle comprises sheets having a different surface area size than sheets in the second sheet bundle.

14. The image forming apparatus according to claim wherein the first switch is a relay, if the sheet bundle contained in the containing component is a plain paper, the first switch is in an ON state, and if the sheet bundle contained in the containing component is thick paper thicker than the plain paper, the first switch is in an OFF state.

15. The image forming apparatus according to claim 14, wherein the plain paper has a basis weight of about 35 to 90 g/m$^2$, and the thick paper has a basis weight of more than 90 g/m$^2$.

16. The image forming apparatus according to claim 14, wherein the plain paper has a same surface area size as the thick paper.

17. The image forming apparatus according to claim 10, wherein the heater is one of a hot air heater or a panel-like heater.

18. The image forming apparatus according to claim 10, wherein the thermostat controls the driving state of the heater based on whether an ambient temperature is above or below 20° C.

19. A paper feeding device, comprising:

a containing component configured to contain a sheet bundle;

a conveyance component configured to convey sheets from the sheet bundle contained in the containing component one sheet by one;

a heater configured to heat the sheet bundle contained in the containing component;

a wiring configured to supply electric power to the heater;

a thermostat configured to control a driving state of the heater; and a first switch insertable in a middle of the wiring and switchable between an ON state and an OFF state of the wiring in response to an input control signal, wherein the first switch is a relay, if the sheet bundle contained in the containing component is a plain paper, the first switch is in an ON state, and if the sheet bundle contained in the containing component is thick paper thicker than the plain paper, the first switch is in an OFF state.

20. The paper feeding device according to claim 19, wherein the plain paper has a basis weight of about 35 to 90 $g/m^2$, and the thick paper has a basis weight of more than 90 $g/m^2$.

* * * * *